United States Patent [19]

Wakefield, Jr.

[11] Patent Number: 4,604,609

[45] Date of Patent: Aug. 5, 1986

[54] SECURITY SYSTEM

[76] Inventor: George H. Wakefield, Jr., 85 W. First St., Lake Ronkonkoma, N.Y. 11779

[21] Appl. No.: 714,470

[22] Filed: Mar. 21, 1985

[51] Int. Cl.[4] ..... G08B 13/12

[52] U.S. Cl. ..... 340/548; 340/545; 340/668; 116/6; 116/75; 116/86; 116/92; 200/61.18; 200/61.81

[58] Field of Search ..... 340/548, 545, 546, 570, 340/665, 668; 116/6, 9, 10, 75, 77, 79, 81, 85, 86, 92, 94, 165; 200/61.18, 61.74, 61.76, 61.77, 61.81, 61.85

[56] References Cited

U.S. PATENT DOCUMENTS

| | | | |
|---|---|---|---|
| 198,337 | 12/1877 | Bolt | 116/81 |
| 2,228,120 | 1/1941 | Koehler | 340/548 |
| 4,205,305 | 5/1980 | Nakada | 116/81 |

*Primary Examiner*—Donnie L. Crosland
*Attorney, Agent, or Firm*—Leonard Belkin

[57] ABSTRACT

A security arrangement for a closed door having an elongated member connected between the door and the wall and a tautly mounted string joining the door knob and an electrical switch on the wall, the string passing over the elongated member. When an attempt is made to open the door tension on the string is increased resulting in the switch being moved into its closed position thereby energizing an alarm device.

7 Claims, 5 Drawing Figures

SECURITY SYSTEM

BACKGROUND OF THE INVENTION

This invention relates to a security system for entryways and the like and more particularly to an arrangement very sensitive to unauthorized opening movement of a door for initiating an alarm.

A variety of arrangements and systems exist for outfitting a closed door to produce an alarm in the event of an unauthorized attempt to open the door. Devices which are currently available or are in use to accomplish such a result are either very elaborate and hence expensive or do not have sufficient sensitivity to provide adequate warning for the person inside who is relying on the presence of such an alarm.

U.S. Pat. Nos. 886,355, 914,173, 1,118,120, and 3,597,555 all show arrangements which are incapable of responding to slight movements of the doors and at the same time include elaborate mechanical and electrical configurations. In U.S. Pat. Nos. 3,887,909 the alarm device disclosed is quite expensive and would not be available to the average home owner or apartment dweller.

SUMMARY OF THE INVENTION

The present invention combines the benefits of low cost with economy and great sensitivity to slight door movements in a single system for alarming a door or other closure.

A preferred embodiment of the invention comprises in combination with a door having a knob mounted in the doorway of a wall, a security arrangement comprising an elongated, rigid member having a fixed loop at one end and a latched loop at the other end, an eye mounted on the door adjacent the edge which swings open adapted to engage one of the loops of the elongated member and a second eye mounted on the wall adjacent the eye on the door adapted to engage the other loop on the elongated member. When the door is closed and the elongated member is engaged at both ends a string is attached at one end to the door knob and is pulled taut over the elongated member and tied at the other end to an electrical switch in its closed position. When the door is pushed in the direction of being opened, tension is induced in the string, and the switch is flipped into its on position, activating any type of electrical device plugged into the outlet controlled by the switch including lights, radio, etc.

The arrangement just described is simple and economical in construction as well as being reliable, easy to install, and very sensitive to slight movements of the door.

It is thus a principal object of this invention to provide a security system for use with doorways and the like.

It is another object of this invention to provide a simple, mechanical alarming arrangement for a door capable of warning a resident within of an attempt to open the door.

Other objects and advantages of this invention will become obvious from the following description of a preferred embodiment of this invention.

DETAILED DESCRIPTION OF THE PREFERRED EMBODIMENTS

Figure 1:
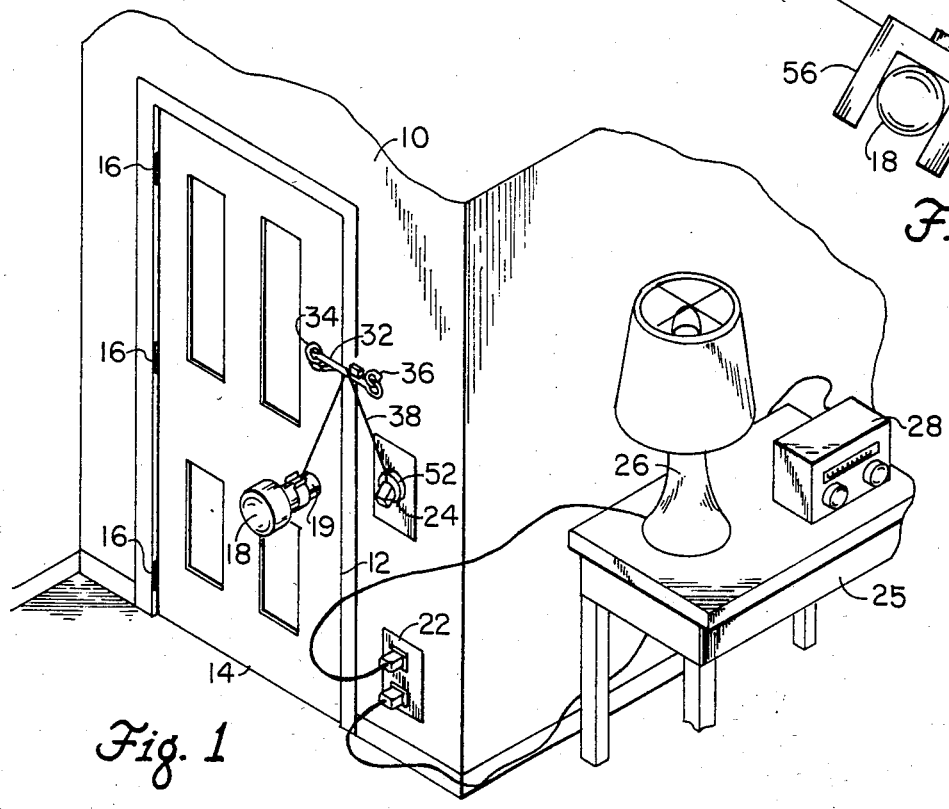
FIG. 1 is an isometric view of a doorway incorporating a preferred embodiment of this invention.

Referring to FIG. 1 there is illustrated the interior of a room having a wall 10 with a doorway 12 controlled by a door 14 with hinges 16 and a knob 18 with its shaft 19. Wall 10 is provided with an electrical outlet 22 controlled by a toggle switch lever 24 in accordance with current usage. A table 25 supports a lamp 26 and a radio or other alarm device 28 plugged into outlet 22 as illustrated.

Figure 3:
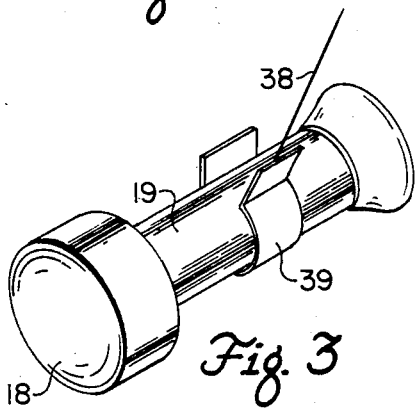
FIG. 3 is a detail of the door knob with the string looped thereon.

The security system embodying the principles of this invention consists of a clasp 32 joined at its ends to a pair of eye screws 34 and 36 mounted in door 14 and wall 10, respectively, and a string 38 tied or looped at one end to toggle switch lever 24, passing over and around clasp 32 and tied at its other end to door knob 18. String 38 is pulled taut so that a slight movement of door 14 being opened will flip switch 24 into its on position resulting in lamp 26 being turned on and radio or other alarm device 28 being actuated. The blaring of radio 28 will warn the occupant of the premises as well as, in most cases, scare off the intruder. As seen in FIG. 3, a clip 39 snapped on shaft 19 may be employed to restrain string 38 so that the turning of knob 18 and its shaft 19 will increase tension in string 38 sufficient to flip switch 24 and activate the alarm.

Figure 2:
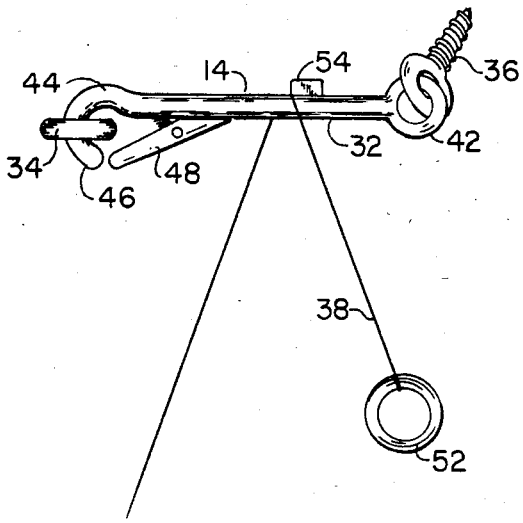
FIG. 2 shows details of the clasp and associated elements.

For details of clasp 32, eye screws 34 and 36, and string 38, reference is made to FIG. 2. Clasp 32 is an elongated member with a fixed eye 42 at one end and a latched eye 44 at its other end. Eye 42 is permanently engaged to eye screw 36 which in this embodiment is threaded into wall 10. An identical eye screw 34 is mounted in door 14 and latched eye 44 of clasp 32 engages this screw. Latched eye 44 consists of a fixed semicircular hook 46 and a pivoted member 48. The latter as is understood in the art may be spring biased to close off the opening into hook 46 so that engagement and disengagement with eye screw 34 may be accomplished by depressing or raising hook 48.

String 38 may be provided at one end with a rubber or plastic ring 52 to be placed on toggle switch lever 24. The other end of string 38 is wrapped around shaft 19 of knob 18 as earlier described, including the clamp 39 to insure that the alarm will go off by the mere turning of knob 18. One or more spikes 54 on clasp 32 may be employed to keep string 38 from slipping or moving along clasp 32.

Figure 5:
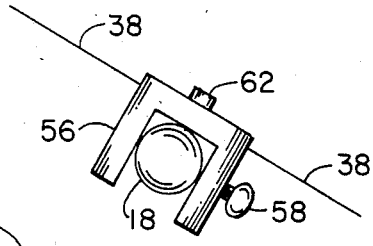
FIG. 5 is an alternative arrangement for connecting the string to a door knob.

As an alternative to the clamping arrangement shown in FIG. 3, a clamp 56 as seen in FIG. 5 may be employed. Clamp 56 is U-shaped and placed on door knob 18 with a thumb operated screw 58 to lock the former in place. Clamp 56 is provided with a unidirectional channel through which string 38 is pulled taut with a button 62 in order to release string 38. One direction pull and lock channels with a release button are known in the art and here it would be incorporated into the U-shaped clamp 56.

When installing the security arrangement, clasp 32 is secured as shown in FIG. 1 and ring 52 is placed on toggle switch lever 24. String 38 is placed over clasp 32 and then pulled taut enough to almost move toggle switch lever 24 and wrapped on or tied at the other end to door knob 18.

Figure 4:
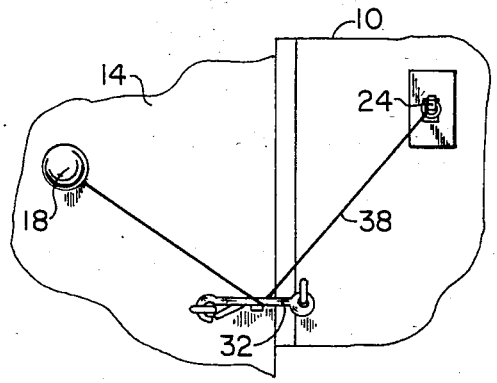
FIG. 4 illustrates an alternative installation of the security system.

In the event that toggle switch lever 24 is closed in the up position, then the arrangement can be as illustrated in FIG. 4 with clasp 32 located below knob 18.

The security arrangement herein described has been tested and is found to be reliable and extremely sensitive to small movements of the door when the system is properly installed. It is seen that the system is simple in construction and easy to put in place and that no tools are required. The cost of such a system is very low so that it is within reach of virtually any person who believes he has need for such a system.

While only preferred embodiments of this invention have been described it is understood that many variations are possible without departing from the pinciples of this invention as defined in the claims which follow.

What is claimed is:

1. In combination with a door having a knob mounted in the doorway of a wall, a security arrangement comprising an elongated, rigid member having a fixed loop at one end and a latched loop at the other end, first loop means mounted on said door adjacent the side of said door which swings open adapted to engage one of the loops of said elongated member, second loop means mounted on said wall adjacent said first loop means for engaging the other loop of said elongated member, so that when said door is closed said elongated member may be engaged with the loops mounted on said door and said wall, string means tied at one end to said door knob and stretched taut over said elongated member, and means for engagement with the other end of said string means for producing an alarm when the tension in said string means is increased due to an attempted opening of said door causing said elongated member to move.

2. The security arrangement as recited in claim 1 in which the alarm producing means is a switch mounted on said wall controlling an electrical circuit with said string means looped thereon to throw said switch when said tension is increased.

3. The security arrangement as recited in claim 2 in which said latched loop on said elongated means consists of a fixed semicircular ring and a pivoted semicircular ring for permitting access of the loop to be engaged therewith.

4. The security arrangement as recited in claim 3 in which said elongated means is provided with means to prevent said string means from sliding along said elongated means.

5. The security arrangement as recited in claim 4 in which said door knob is provided with means to restrain said string means so that said switch is thrown by the mere turning of said door knob.

6. The security arrangement of claim 5 in which the restraining means is a clip mounted on the shaft attached to said door knob.

7. The security arrangement of claim 5 in which the restraining means is a clamp mounted on said door knob having means to permit said string to be pulled taut and locked.

* * * * *